United States Patent [19]

Albanese

[11] 4,190,815

[45] Feb. 26, 1980

[54] HIGH POWER HYBRID SWITCH

[75] Inventor: Victor J. Albanese, Valley Stream, N.Y.

[73] Assignee: The United States of America as represented by the Secretary of the Air Force, Washington, D.C.

[21] Appl. No.: 884,882

[22] Filed: Mar. 9, 1978

[51] Int. Cl.[2] ..... H01P 1/12

[52] U.S. Cl. ..... 333/101; 333/109; 333/111

[58] Field of Search ..... 333/7 R, 10, 101, 109, 333/111, 113, 114, 115, 116

[56] References Cited

U.S. PATENT DOCUMENTS

| | | | |
|---|---|---|---|
| 2,973,512 | 2/1961 | Walsh | 333/109 |
| 3,419,821 | 12/1968 | Jones | 333/11 |
| 3,480,885 | 11/1969 | Schrank | 330/11 |
| 3,571,765 | 3/1971 | Friedman | 333/31 |
| 3,659,227 | 4/1972 | Whistler | 333/7 |
| 3,769,610 | 10/1973 | Savarin et al. | 333/10 |

*Primary Examiner*—Eugene R. LaRoche
*Assistant Examiner*—Robert E. Wise
*Attorney, Agent, or Firm*—Joseph E. Rusz; Willard R. Matthews, Jr.

[57] ABSTRACT

High levels of R.F. power are controlled and switched by means of a hybrid switching network that employs an intermediate power level switch matrix in conjunction with a pair of 8.34 (nominal) directional couplers and a phasing network. The two directional couplers are connected in tandem by two equal length transmission lines to form a broadband quadrature 3dB hybrid. Switching is accomplished by selectively inserting a 180° phase shift means into the lower power carrying transmission line. The phase shifting means can be a length of transmission line, a solid state device, or a Schiffman type phase shifter.

8 Claims, 6 Drawing Figures

HIGH POWER HYBRID SWITCH

BACKGROUND OF THE INVENTION

This invention relates to hybrid switching circuits and in particular to novel switching techniques and apparatus that permit high power switching with intermediate power level switching means.

Many electronic systems require the switching of high current carrying lines with bw or intermediate power switching devices. A particular example of this, and one in which the present invention finds great utility, is the control of the feeds to airborne antennas that are remotely switched between two modes of operation. Systems of this type commonly employ a pair of antennas that are fed by a switching circuit that provides either full power to one antenna (single mode operation) or half power to each antenna (double mode operation). It is usually required that such antennas transmit several kilowatts of average c.w. power over a wide frequency range while maintaining low VSWR characteristics. Conventional switching methods used to produce the "dual" or "single" mode performance have been found inadequate either because of the adverse effect of changing impedance levels on VSWR or because of the size and weight limitations of the full power switches. Although 3dB hybrid switches have been used to switch between full power to one of two feeds and one half power to each of the two feeds they also have limitations that render them less than desirable for many applications. In particular, the conventional quarter wave 3dB hybrid is restricted in power handling capability and manifests performance sensitivity to tolerance variations. Such a device also requires "touchy" tuning devices at higher frequencies. Other currently available switching means also exhibit the foregoing and other undesirable characteristics. Accordingly there currently exists the need for a high power, light weight switch suitable for airborne applications that is not subject to the above enumerated deficiencies of known switching circuits. The present invention is directed toward satisfying that need.

SUMMARY OF THE INVENTION

The invention comprises a 3dB hybrid switch that is made up of two 8.34dB (nominal) directional couplers connected in tandem by two equal length transmission lines. The power traveling along one of the transmission lines is diminished from the input power by the coupling factor of the first directional coupler. A 180° phase shifter is selectively insertable into the low power transmission line by means of intermediate power level switches Power fed to the 3dB hybrid input splits equally and with quadrature phase to the two output ports in the absence of the 180° phase shifter. All of the power is transmitted to a single output port when the 180° phase shifter is inserted into the low power carrying transmission line. The phase shifter may be an appropriate length of transmission line, a solid state device or a Schiffman phase shifter. The Schiffman phase shifter provides a device that is insensitive to frequency.

It is a principal object of the invention to provide a new and improved high power hybrid switch.

It is another object of the invention to provide a 3dB hybrid switch in which high power can be switched with intermediate power level switches.

It is another object of the invention to provide a 3dB hybrid switch that is insensitive to frequency.

It is another object of the invention to provide means for switching power to airborne antennas that does not adversely effect system VSWR characteristics.

It is another object of the invention to provide a 3dB hybrid switch that is lightweight and suitable for airborne use.

These together with other objects, features and advantageous of the invention will become more readily apparent from the following detailed description taken in conjunction with the illustrative embodiment in the accompanying drawings.

FIG. 1 is a schematic diagram of one presently preferred embodiment of the invention;

FIG. 2 illustrates the voltage vector relationships at the output ports 2 and 3 of the circuit of FIG. 1 with an input at input port 1, at mid-band frequency, $F_o$, for the case of equal connecting lines.

FIG. 3 illustrates the voltage vector relationships at the output ports 2 and 3 of the circuit of FIG. 1 with an input at input port 1, at mid-band frequency, $F_o$, for the case of one interconnecting line including a 180° phase shift;

FIG. 4 is a graph of calculated performance of the dual mode switching network of the invention showing coupling from input port 1 to output ports 2 and 3 for dual mode ($\phi_A=\phi_B$);

FIG. 5 is a graph of calculated performance of the dual mode switching network of the invention showing coupling from input port 1 to output ports 2 and 3 for single mode ($\phi_A=\phi_B\pm180°$ $F/F_o$); and FIG. 6 is a schematic diagram of an embodiment of the invention utilizing a Schiffman phase shifter.

DETAILED DESCRIPTION OF THE PREFERRED EMBODIMENT

Figure 1:
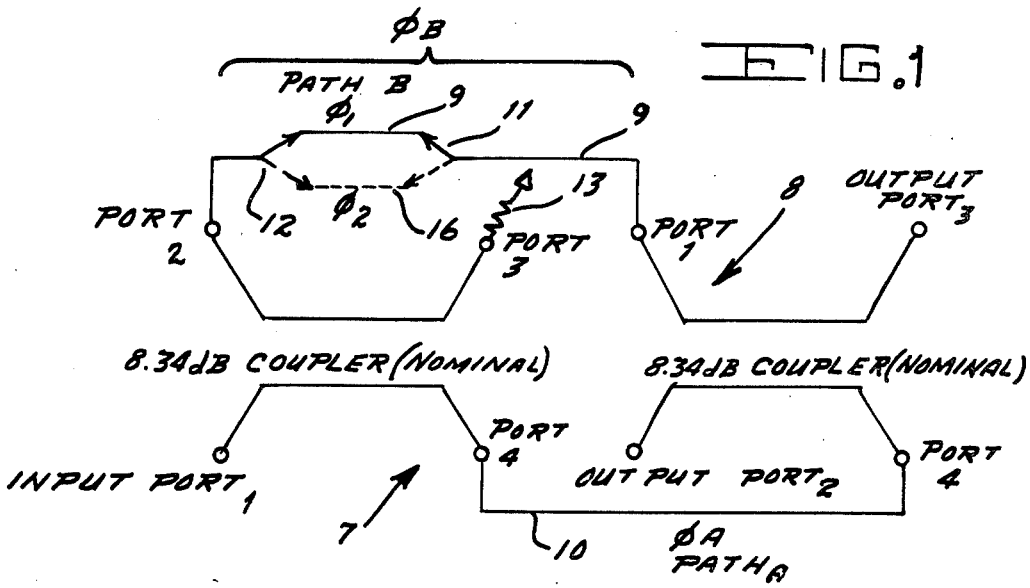

The high power 3dB hybrid switch comprehended by the invention is illustrated in schematic form in FIG. 1. Referring thereto a 3dB hybrid is formed by connecting 8.34dB directional couplers 7 and 8 in tandem by means of equal length transmission line circuits 9 and 10. Each directional coupler has four ports with transmission line circuit 9 connecting port 2 of coupler 7 to Port 1 of coupler 8 and transmission line circuit 10 connecting the ports of each coupler designated as port 4. Port 1 of directional coupler 7 is an input for the 3dB hybrid and ports 2 and 3 of directional coupler 8 are the outputs. Port 3 of directional coupler 7 is an isolation port and is terminal with a load 13. Transmission line circuit 9 includes switches 11 and 12 that are adapted to switch a 180° phase shift means 16 into the circuit. The 180° phase shift means 16 can be a length of transmission line of appropriate length, a solid state device, or a Schiffman type phase shift network.

Figure 2:
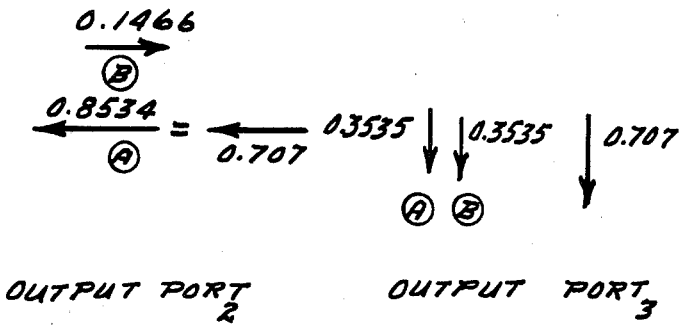
Figure 3:
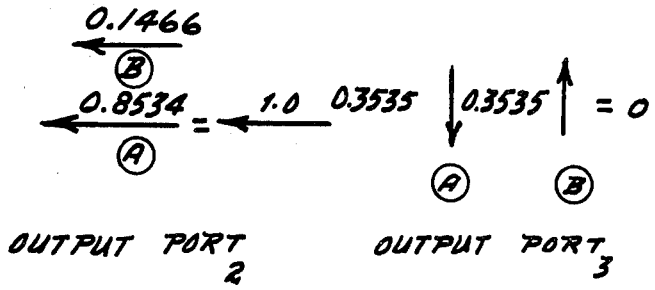

A description of the modes of operation of the 3dB hybrid switch above described together with an analytical derivation of equations governing its behavior are now presented. Referring to FIG. 1, it is seen that with the switches in the $\phi_1$ position, the total insertion phases of the two interconnecting lines (paths A and B) are identically equal and the power splits equally between output ports 2 and 3 with quadrature phase (vectorially shown in FIG. 2). It can also be shown that if, with the switches in the $\phi_2$ position, the total insertion phase of paths A and B differ by ±180° so that $\phi_A=\phi_B\pm180°$, all the input power will arrive at output port 2 and no power will be present at output port 3. This can be simply shown for the exact vector relationship of the 8.34 db couplers at fo by referring to FIG. 3.

The equations governing the distribution of power to output ports 2 and 3 for varying values of coupling and frequency are derived below for both modes of operation:

For a single coupler with input to port 1, coupled output at port 2', and main output at port 3':

$$\frac{E_2'}{E_1} = K_{12}' = \frac{j\,c\sin\theta}{\sqrt{1-c^2}\cos\theta + j\sin\theta} \tag{1}$$

and:

$$\frac{E_3'}{E_1} = K_{13}' = \frac{\sqrt{1-c^2}}{\sqrt{1-c^2}\cos\theta + j\sin\theta} \tag{2}$$

where:

c is the coupling factor or midband value of coupling $\theta$ is the electrical length of the coupled line, and is equal to to $\pi/2$ at midband frequency, fo. The above equations may be written in the following form:

$$|K_{12}'| = \frac{c\sin\theta}{\sqrt{1-c^2\cos^2\theta}} \tag{3}$$

$$\theta_{12}' = \frac{\pi}{2} - \tan^{-1}\left(\frac{\tan\theta}{\sqrt{1-c^2}}\right) \tag{4}$$

$$|K_{13}'| = \frac{\sqrt{1-c^2}}{\sqrt{1-c^2\cos^2\theta}} \tag{5}$$

$$\theta_{13}' = -\tan^{-1}\left(\frac{\tan\theta}{\sqrt{1-c^2}}\right) \tag{6}$$

$$\theta_{12}' = \frac{\pi}{2} + \theta_{13}' \tag{7}$$

For a pair of identical and synchronously tuned tandem couplers, with interconnecting lines $\phi_A$ and $\phi_B$, as shown schematically in FIG. 1, where:

$$\phi_A = \phi_B + \beta \tag{8}$$

$$\frac{E_2}{E_1} = [|K_{13}'|^2 \angle 2\,\theta_{13}'] + [|K_{12}'|^2 \angle \pi + 2\,\theta_{13}' + \beta]$$

and:

$$\frac{E_3}{E_1} = \left[|K_{12}'|\,|K_{13}'|\,\angle 2\,\theta_{13}' + \frac{\pi}{2}\right] + \left[|K_{12}'|\,|K_{13}'|\,\angle 2\,\theta_{13}' + \frac{\pi}{2} + \beta\right] \tag{9}$$

A. Dual Mode

When $\beta=0$ an inspection of the above equation shows that the magnitudes of the vector sums are:

$$\left|\frac{E_2}{E_1}\right| = |K_{13}'|^2 - |K_{12}'|^2 = \frac{1-c^2(1+\sin^2\theta)}{1-c^2\cos^2\theta} \tag{10}$$

and:

$$\left|\frac{E_3}{E_1}\right| = 2\,|K_{12}'|\,|K_{13}'| = \frac{2\,c\sqrt{1-c^2}\sin\theta}{1-c^2\cos^2\theta} \tag{11}$$

B. Single Mode

When $\beta=\pi$, the equations reduce to:

$$\left|\frac{E_2}{E_1}\right| = |K_{13}'|^2 + |K_{12}'|^2 = \frac{1-c^2+c^2\sin^2\theta}{1-c^2\cos^2\theta} = \frac{1-c^2(1-\sin^2\theta)}{1-c^2\cos^2\theta} = 1 \tag{12}$$

and:

$$\left|\frac{E_3}{E_1}\right| = |K_{12}'|\,|K_{13}'| - |K_{12}'|K_{13}'| = 0 \tag{13}$$

Note that the relationships for the case of $\beta=\pi$ are independent of frequency if $\beta$ is independent of frequency. For the specific case where $\beta$ is frequency dependent, as in the use of a coaxial cable which is $\lambda/2$ at fo, the above two equations may be reduced to:

$$P_{12} = \left(\frac{E_2}{E_1}\right)^2 = \frac{(1-c^2)^2 + c^4\sin^4\theta + 2(1-c^2)c^2\sin^2\theta\cos\gamma}{(1-c^2\cos^2\theta)^2} \tag{14}$$

$$P_{13} = \left(\frac{E_3}{E_1}\right)^2 = 2\left(\frac{C\sqrt{1-c^2}\sin\theta}{1-c^2\cos^2\theta}\right)(1-\cos\gamma) \tag{15}$$

where: $\beta=\pi f/fo$ and:

$$\gamma = \pi - \beta = \pi\left(1 - \frac{f}{fo}\right)$$

Figure 4:
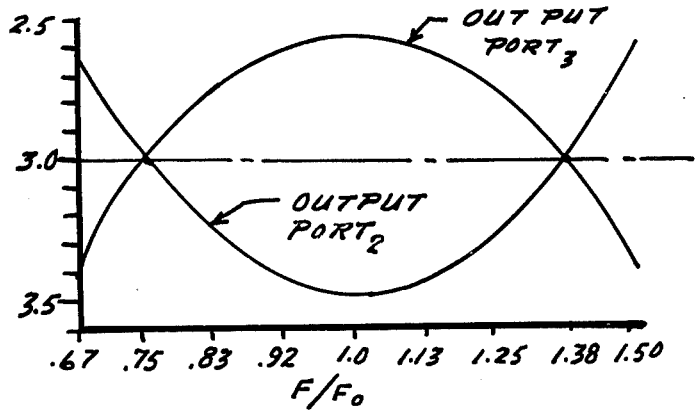
Figure 5:
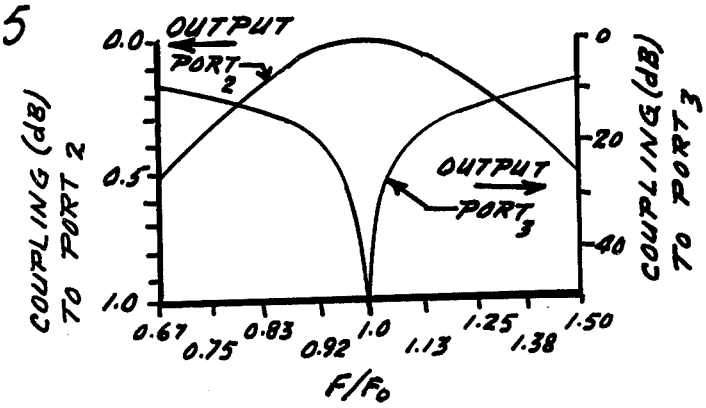

By way of example the foregoing equations were programmed onto a computer and performance was calculated over an approximate octave frequency band. Two conditions of phase shift were considered for the case of single output only to port 2; namely that the 180° differential phase shift is either frequency invariant as approximated by a Schiffman phase shifter network or that it varies linearly with frequency as with a coaxial cable. The calculated lossless performance of the full network for both modes of operation with frequency varying phase shift ($\beta=\pi f/fo$) is shown in FIG. 4 and 5. Also, optimized center frequency coupling to achieve minimum deviations from equal power split in the dual mode was found to be approximately 7.83dB.

Figure 6:
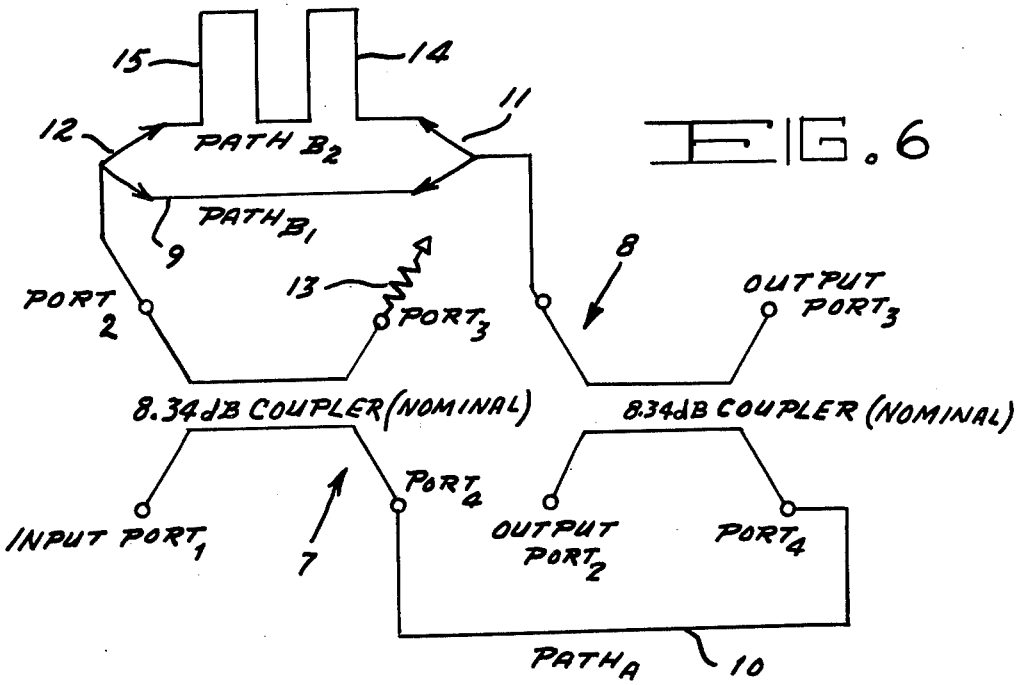

Since a 180° differential phase shift is required between paths A and B, but a conventional Schiffman type phase shifter produces a 90° differential phase shift, a "double" network is required. The required condition is shown by the dual Schiffman sections 14, 15 in FIG. 6. For the dual mode, $\phi_A=\phi_{B1}$, and this is achieved as before by simply balancing overall line lengths of 10. For the single mode, path A has a line length, which is 540° longer than the line length (including switches) of path B2. The B2 path is completed with the inclusion of and dual Schiffman sections.

While the invention has been described in one presently preferred embodiment it is understood that the words which have been used are words of description rather than words of limitations and that changes within the purview of the appended claims may be made without departing from the scope and spirit of the invention in its broader aspects.

What is claimed is:

1. A high power hybrid switch comprising
first and second directional couplers,
first and second transmission line circuits connecting said first and second directional couplers in tandem to form a 3dB hybrid, and
phase shift means selectively insertable into said first transmission line circuit.

2. A high power hybrid switch as defined in claim 1 wherein said first and second transmission line circuits are of equal length and said phase shift means comprises means for switching a 180° phase shift length of transmission line into said first transmission line circuits.

3. A high power hybrid switch as defined in claim 2 wherein said phase shift means comprises means for switching a 180° phase shift solid state device into said first transmission line circuit.

4. A high power hybrid switch as defined in claim 2 wherein said phase shift means comprises means for switching a 180° Schiffman type phase shift network into said first transmission line circuit.

5. A high power hybrid switch as defined in claim 4 wherein said second transmission line circuit has a line length that is 540° longer than the first transmission line circuit including said 180° Schiffman type phase shift network.

6. A high power hybrid switch as defined in claim 1 wherein said first and second directional couplers are nominally 8.34dB couplers.

7. A high power hybrid switch as defined in claim 6 wherein said phase shift means is adapted to insert a 180° phase shift into said first transmission line circuit.

8. A high power hybrid switch as defined in claim 7 wherein said first and second directional couplers each have a first, a second, a third and a fourth port, said first transmission line circuit connecting the first port of said directional coupler and the first port of said second directional coupler, said second transmission line circuit connecting the fourth port of said first directional coupler and the fourth port of said second directional coupler, the second port of said first directional coupler comprising the 3dB hybrid input, the third port of said first directional coupler connected as an insolated terminal port, and the second and third ports of said second directional coupler comprising the 3dB hybrid output ports.

* * * * *